US005245939A

United States Patent [19]

Rouhling

[11] Patent Number: 5,245,939

[45] Date of Patent: Sep. 21, 1993

[54] WEB SUPPORTING EDGE RECEIVING FABRIC

[75] Inventor: Jean A. M. Rouhling, Montbron, France

[73] Assignee: Scapa Group plc, Blackburn, England

[21] Appl. No.: 906,500

[22] Filed: Jun. 30, 1992

[30] Foreign Application Priority Data

Jul. 13, 1991 [GB] United Kingdom ..... 9115120

[51] Int. Cl.[5] ..... D03D 11/02

[52] U.S. Cl. ..... 112/441; 139/383 A; 139/383 R; 428/222; 162/193

[58] Field of Search ..... 162/902, 193, 283; 139/383 A, 383 R; 34/123, 116, 158; 428/222; 26/1, DIG. 1; 112/441; 226/91

[56] References Cited

U.S. PATENT DOCUMENTS 2,797,713 7/1957 Hoffacker .

3,885,603 5/1975 Slaughter ..... 139/383 A X 4,693,405 9/1987 Masse .

4,870,998 10/1989 Westhead ..... 139/383 A

*Primary Examiner*—Andrew M. Falik

*Attorney, Agent, or Firm*—Keck, Mahin & Cate

[57] ABSTRACT

A fabric for use in supporting a cellulose pulp sheet during passage through a Flakt dryer which is of asymmetric double weave construction, the fabric being folded into V-shaped configuration and there being essentially uncrimped, essentially inextensible load bearing yarns positioned between the weft yarns of the respective fabric layers and extending in the longitudinal direction of the fabric, adjacent ones of the load bearing yarns being separated by warp yarns of the less densely woven inner layer which weave also with the weft yarns of the outer layer. The more densely woven outer layer protects the load bearing yarns from wear and from the adverse effects of heat.

15 Claims, 2 Drawing Sheets

WEB SUPPORTING EDGE RECEIVING FABRIC

FIELD OF THE INVENTION

The invention concerns papermakers and like fabrics and has more particular reference to fabrics as used in the manufacture of cellulose pulp sheet in continuous form.

BACKGROUND OF THE INVENTION

Description of Related Art

In the manufacture of cellulose pulp sheet material, and more particularly in the drying thereof, a moist pulp sheet in continuous form is progressed in serpentine manner about a plurality of rollers provided within a closed dryer, the sheet being of sufficient inherent rigidity to maintain its integrity, although a degree of support may be provided by pulsed air within the dryer. Conveniently the sheet is advanced by applying a drive motion to one or more of the rollers existing within the dryer although other drive rollers may be provided if preferred.

At the start up of production, or in the event of sheet breakage, the pulp sheet width is temporarily reduced to provide a tail which is fed through the dryer section. Gradually, as the tail proceeds along the circuit the sheet width is increased until a full-width state is reached. The guiding mechanism for the pulp sheet tail is the woven fabric, the subject of the present invention, the fabric being in folded V-form and engaging the edge of the pulp sheet and pulling such sheet along the circuitous dryer path. The guide fabric is in the form of a closed loop, and tension and guiding mechanisms therefor are provided in that run thereof which exists externally of the dryer.

When the pulp sheet has been widened to full width and this part is starting to leave the dryer, the guide fabric is normally pulled away from the sheet and is then "parked" in a stationary position until it is re-utilized on a later occasion. In an alternative arrangement, the pulp sheet is cut at a position just along the outside edge of the guide fabric, so that, in effect, the sheet is shifted across the machine width by the width of the guide fabric. The drying of the pulp sheet is effected by circulation of hot dry air within the dryer.

The nature of the pulp sheet and the high moisture content thereof necessitates a dryer run of significant proportions and fabrics of the kind to which the invention relates are typically 1 kilometer in length.

Dimensional stability of the fabric in the lengthwise direction thereof is particularly important and, in view of the significant length of the fabric involved, difficulty is experienced in producing a fabric capable of maintaining its length within acceptable limits.

It is known that, contrary to previous indications, paralinked aramid yarns are of application in the field of papermachine and like clothing notwithstanding their susceptibility to physical damage and the adverse effect thereon of extended exposure to heat and moisture. It has, however, hitherto been thought necessary to provide some form of insulation of the paralinked aramid yarns against the adverse effect of extended exposure to heat and moisture by locating such yarns within the body of the fabric, and more particularly by providing the paralinked aramid yarns within a core of yarns, ad prior proposals have been directed accordingly.

SUMMARY OF THE INVENTION

According to one aspect of the present invention there is proposed a papermakers or like fabric, and more particularly a fabric to receive an edge of a cellulose pulp sheet into engagement therewith for support of the said sheet during passage through the dryer section of a sheet-making machine, the fabric comprising a narrow textile structure folded about an axis extending in the longitudinal direction thereof and means adjacent the line of fold securing said structure in said folded form, characterized in that the said structure is of asymmetric, double weave configuration having a first set of warp and weft yarns woven together to give a relatively dense, wear-resistant outer layer and a second set of warp and weft yarns forming an inner layer of relatively open weave, some at least of the warp yarns of the inner layer being collectively woven with the weft yarns of the outer layer to secure the two layers together, the structure further including essentially uncrimped, essentially inextensible load-bearing warp yarns positioned intermediate the weft yarns of the inner layer and the said outer layer and extending in the longitudinal direction of the fabric.

According to a preferred feature, all of the warp yarns of the inner layer are woven collectively with the weft yarns of the outer layer.

According to another aspect of the invention there is proposed a papermakers and like fabric, and more particularly a fabric to receive an edge of a cellulose pulp sheet into engagement therewith for support of the said sheet during passage through the dryer section of a sheet-making machine, the fabric comprising a narrow textile structure folded about an axis extending in the longitudinal direction thereof and means adjacent the line of fold securing said structure in said folded form, characterized in that the said structure is of asymmetric, double layer configuration defined by a relatively dense, wear-resistant outer layer comprising a first set of warp and weft yarns woven together, an inner layer of relatively open weave and comprising a second set of interwoven warp and weft yarns, and binder yarns woven with the weft yarns of the two layers to secure said layers together, the structure further including essentially uncrimped, essentially inextensible load-bearing warp yarns positioned intermediate the weft yarns of the inner outer layers and extending in the longitudinal direction of the fabric.

According to a further preferred feature, the essentially inextensible load-bearing warp yarns comprise paralinked aramid yarns.

The present invention is predicated upon the appreciation that, in the context of the V shaped fabrics engageable with the edge of a cellulose pulp sheet to support and progress the same through the dryer, for example a Flakt dryer, quite different considerations apply as regards the need to protect the paralinked aramid yarns in the structure as woven.

BRIEF DESCRIPTION OF THE DRAWING

The invention will now be described further, by way of example only, with reference to the accompanying diagrammatic drawings in which.

DETAILED DESCRIPTION

Figure 1:
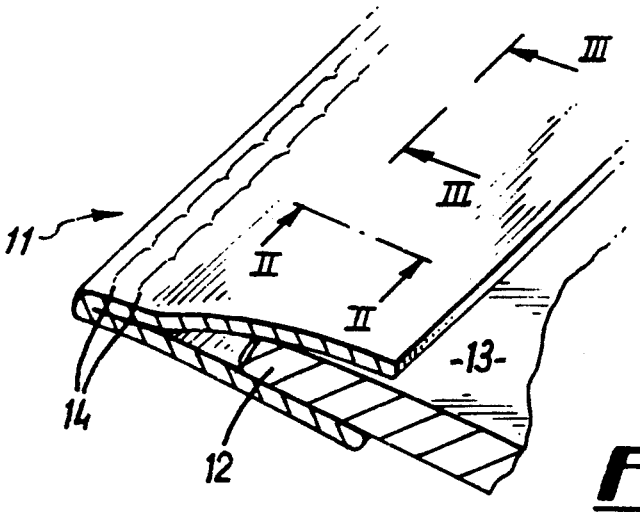
FIG. 1 is an illustration of the fabric of the present invention engaged with the edge of a pulp sheet.

Thus, referring now to the drawings, a fabric 11 for engaging the edge 12 of a moist pulp sheet 13 to support and progress the same through a dryer, not shown, is of V-shaped configuration, being formed by folding an elongate woven textile structure about a line extending longitudinally thereof and securing the same in such configuration as, for example, by stitching, as at 14. Other means of securing the structure in V-shaped configuration may, of course, be adopted, such as staples/-rivets or adhesives.

Figure 2:
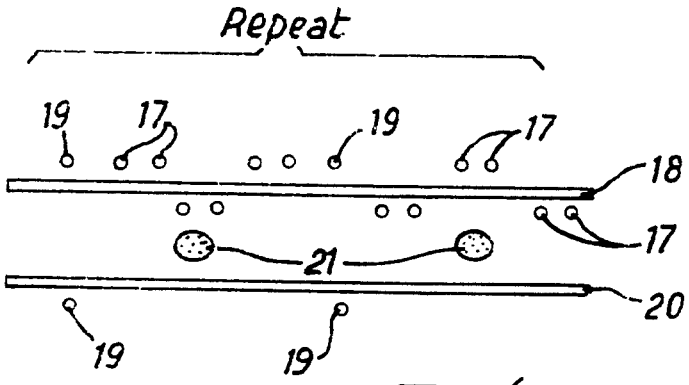
FIGS. 2 and 3 are sections taken on line II—II and III—III of FIG. 1 respectively, and illustrate the weave structure of the fabric.
Figure 3:
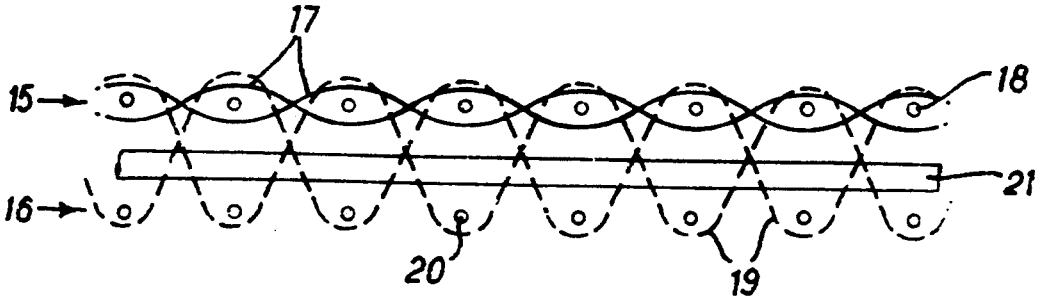

The woven textile structure is shown in FIGS. 2 and 3 and comprises a relatively densely woven outer layer 15 and an inner layer 16 of a relatively open weave. The outer layer 15 is formed by a first set of warp and weft yarns 17, 18 respectively woven together to give a plain weave, the warp yarns 17 being disposed in horizontal pairs, while the inner layer 16 comprises a second set of warp and weft yarns 19, 20 respectively, the warp yarns 19 weaving not only with weft yarns 20 but also with the weft yarns 18 of the outer layer thereby to join the layers together. While all of the warp yarns 19 will ordinarily weave also with the weft yarns of the outer layer, some only of such warp yarns may so weave.

The woven structure further includes essentially uncrimped, load-bearing yarns 21 positioned inwardly of the fabric with respect to the weft yarns 20 and existing between such weft yarns 20 and weft yarns 18, the load bearing yarns 21 extending in the longitudinal direction of the fabric.

The warp and weft yarns 17 to 20 are Nomex yarns, the weft yarns in the two fabric layers being equal in number and being paired one above the other.

In the particular structure under consideration successive load-bearing straight warp yarns 21 are separated by two warp yarns 19, the load-bearing yarns being para-linked aramid yarns. Each pattern repeat widthwise of the structures includes eighteen warp yarns, made up of twelve warp yarns 17, four warp yarns 19 and two warp yarns 21, and the pattern is repeated forty-five times in the width of the fabric.

Figure 4:
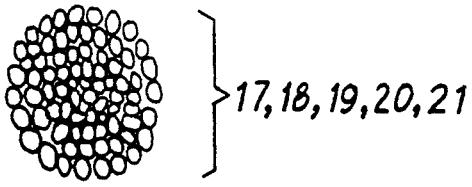
FIG. 4 is a schematic illustration of the multifilament yarns preferred to be used in the invention.

Warp yarns 17, 19 and weft yarns 18, 20 are of 250 Tex, whilst warp yarns 21 are of 380 Tex. Warp yarns 21 may, however, be of 760 Tex or of some other size appropriate to the circumstances. There are, in total 31.5 warp yarns per centimeter and 11 weft yarns per centimeter in the fabric as a whole, the warp yarns being made up of twenty-one warp yarns 17, seven warp yarns 19 and three and a half warp yarns 21 per centimeter. In the embodiment under consideration all of the yarns are of multifilament form, as illustrated in FIG. 4 but staple and/or monofilament yarns or a combination of multifilament, staple and/or monofilament yarns may be preferred in some instances.

In producing the fabric of the invention, the structure as aforesaid is folded about a line extending longitudinally thereof and is sewn in such disposition.

It has been found that the more densely woven outer layer which exists outwardly of the pulp sheet at each face thereof not only provides an adequate degree of wear resistance but also protects the paralinked aramid yarn, for example, that yarn sold under the trade mark Kevlar, from the adverse effect of the surface temperature of the rollers within the dryer, which rollers become heated by the air introduced into such dryer.

The less dense inner layer provides the load-bearing yarns which give dimensional stability to the fabric as a whole, and, furthermore, facilitates folding of the structure into the V-shaped form with minimum prejudice to the capability of the fabric adequately to support the pulp sheet.

The invention is not limited to the embodiment hereinbefore described, since alternatives will readily present themselves to one skilled in the art. Thus, not only are alternative weave patterns possible in relation to the fabric as a whole, but alternatives to the Nomex and paralinked aramid yarns may be used. For example, instead of using Kevlar as the load-bearing straight yarns, it may be preferred to use aromatic ether aramid yarns.

While double weave structures are thought to represent the most realistic way of carrying the invention into effect, a double-layer structure comprising two separate layers simultaneously woven and joined together by warp binder yarns in conventional manner, is of application in the present context, and represents an alternative to the double weave structure herein disclosed.

It is also thought advantageous, in the event that the fabric is to be maintained in folded V-shaped configuration by sewing, to omit various of the warp yarns, and particularly of the outer layer of the structure, in the region of intended fold and thereby provide locations to receive the sewing threads in a manner such as will provide protection therefor against wear. The omission of various of the warp yarns from the region of intended fold has the further benefit of facilitating the folding of the fabric.

Figure 5:
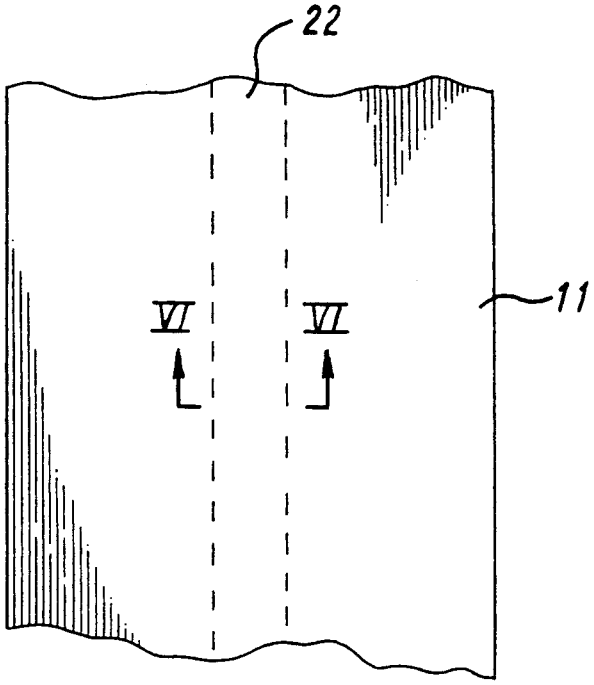
FIG. 5 is an illustration of the fabric shown in FIG. 1 but before folding, the dotted lines indicating a zone of decreased warp yarns.
Figure 6:
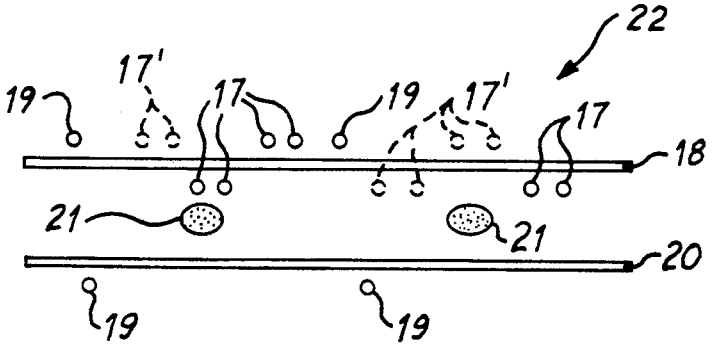
FIG. 6 is a cross-sectional view taken substantially along line VI—VI of FIG. 5.

FIG. 5 is a plan view of the fabric 11 before it is folded into a V-shaped configuration. A central region 22, indicated by dashed lines, corresponds to the location where the fold will occur to produce the structure in FIG. 1. FIG. 6 is a schematic sectional view of this region 22. While some of the warp yarns 17 are present in the central region 22 as elsewhere, other warp yarns 17' are missing, and are therefore shown in phantom.

What is claimed is:

1. A fabric for receiving an edge of a cellulose pulp sheet into engagement therewith for support of the said sheet during passage thereof through the dryer section of a sheet-making machine, the fabric comprising a narrow textile structure folded about an axis extending in the longitudinal direction thereof and means adjacent the line of fold securing said structure in said folded form, characterized in that the said structure is of asymmetric, double weave configuration having a first set of warp and weft yarns woven together to give a relatively dense, wear-resistant outer layer and a second set of warp and weft yarns forming an inner layer of relatively open weave, some at least of the warp yarns of the inner layer being collectively woven with the weft yarns of the outer layer to secure the two layers together, the structure further including essentially uncrimped, essentially inextensible load-bearing warp yarns positioned intermediate the weft yarns of the inner layer and the said outer layer and extending in the longitudinal direction of the fabric.

2. A fabric as claimed in claim 1, wherein all of the warp yarns of the inner layer are woven collectively with the weft yarns of the outer layer.

3. A fabric as claimed in claim 1 wherein the essentially inextensible load-bearing warp yarns comprise paralinked aramid yarns.

4. A fabric as claimed in claim 1, wherein the outer layer is of reduced warp density in the intended fold region of the fabric.

5. A fabric as claimed in claim 1, wherein the said means securing the structure in folded form comprises stitching extending through the folded structure adjacent the line of fold.

6. A fabric as claimed in claim 5, wherein the outer layer is of reduced warp density in register with the intended position of the stitching.

7. A fabric as claimed in claim 1, wherein the weft yarns in the inner and outer layers are equal in number.

8. A fabric as claimed in claim 8, wherein the weft yarns of the inner and outer layers are paired and exist one above the other.

9. A fabric as claimed in claim 1, wherein the outer layer is a plain weave.

10. A fabric as claimed in claim 1, wherein the warp density of the yarns in the outer layer is three times the warp density of the yarns in the inner layer.

11. A fabric as claimed in claim 1, wherein the warp yarns of the outer layer are disposed in horizontal pairs.

12. A fabric as claimed in claim 1, wherein the warp and weft yarns of the inner and outer layers are of like weight per unit length.

13. A fabric as claimed in claim 1, wherein the load-bearing warp yarns are of greater size than the warp and weft yarns of the inner and outer layers.

14. A fabric as claimed in claim 1, wherein all of the yarns are multifilament in character.

15. A fabric for receiving an edge of a cellulose pulp sheet into engagement therewith for support of the said sheet during passage through the dryer section of a sheet-making machine, the fabric comprising a narrow textile structure folded about an axis extending in the longitudinal direction thereof and means adjacent the line of fold securing said structure in said folded form, characterized in that the said structure is of asymmetric, double layer configuration defined by a relatively dense, wear-resistant outer layer comprising a first set of warp and weft yarns woven together, an inner layer of relatively open weave and comprising a second set of interwoven warp and weft yarns, and binder yarns woven with the weft yarns of the two layers to secure said layers together, the structure further including essentially uncrimped, essentially inextensible load-bearing warp yarns positioned intermediate the weft yarns of the inner outer layers and extending in the longitudinal direction of the fabric.

* * * * *